United States Patent [19]

Eder et al.

[11] 4,404,463

[45] Sep. 13, 1983

[54] ELECTRICAL HEATING DEVICE

[75] Inventors: Bernd Eder, Wuppertal; Eckehard Wosthoff, Wermelskirchen, both of Fed. Rep. of Germany

[73] Assignee: Kabelwerke Reinshagen GmbH, Wuppertal, Fed. Rep. of Germany

[21] Appl. No.: 331,730

[22] Filed: Dec. 17, 1981

[30] Foreign Application Priority Data

Sep. 29, 1981 [DE] Fed. Rep. of Germany ..... 3048452

[51] Int. Cl.[3] ..... H05B 3/08

[52] U.S. Cl. ..... 219/541; 174/65 SS; 219/242; 219/219; 219/530; 219/552; 338/22 R

[58] Field of Search ..... 219/219, 222, 530, 242, 219/536, 540, 541, 544, 552, 553; 338/22 R, 22 SD; 132/33 R, 33 F, 40, 41 R; 174/51, 65 SS

[56] References Cited

U.S. PATENT DOCUMENTS

| | | | |
|---|---|---|---|
| 2,972,002 | 2/1961 | Wayman | 174/51 SC X |
| 4,091,267 | 5/1978 | Grant | 219/544 |
| 4,284,877 | 8/1981 | Abura et al. | 219/541 X |

FOREIGN PATENT DOCUMENTS

| | | |
|---|---|---|
| 1465439 | 2/1969 | Fed. Rep. of Germany . |
| 2540029 | 11/1980 | Fed. Rep. of Germany . |
| 7919839 | 2/1980 | Fed. Rep. of Germany . |
| 7929548 | 1/1980 | Fed. Rep. of Germany . |

*Primary Examiner*—Volodymyr Y. Mayewsky

*Attorney, Agent, or Firm*—Reising, Ethington, Barnard, Perry & Milton

[57] ABSTRACT

An electrical heating device is disclosed for heating a plate which, for example, is used for heating the outside rear view mirror of a vehicle. The heating device includes a positive temperature coefficient resistor constructed as a resistive body in the form of a flat cylindrical ring. One flat surface of the ring is seated upon the plate to be heated which is used as one electrical terminal of the resistor. Another metal plate is seated against the other flat surface of the ring and serves as the second electrical terminal and also as a heat distributing plate for the resistive body. A two part fastening means comprising a headed shank and a press-on nut is provided, with the shank extending through the plates and the resistive body to press them against one another to obtain good electrical and thermal conduction.

3 Claims, 2 Drawing Figures

ELECTRICAL HEATING DEVICE

FIELD OF THE INVENTION

This invention relates to an electrical heating device for heating of a plate by use of an electrically resistive body.

BACKGROUND ART

Electrical heating devices for plate-like bodies are known in which a resistor is used for generating and transferring heat to the plate-like body. In such devices, it is known to use a resistor having a positive temperature coefficient of resistance. Such devices have become known, for example, for heating of outside rear view mirrors of motor vehicles. In such devices, the resistor having a positive temperature coefficient is used as a self-regulating heating element. A surface of the resistive body is soldered onto a heat distributing plate and an electrical lead is soldered to the plate and connected with the vehicle body and serves as electrical ground. Another surface of the resistive body is connected by soldering to an electrical lead which is connected through a switch to the power supply of the vehicle to complete the heating circuit. Such arrangements are set forth in German patent DE-GM Nos. 7,919,839 and 7,929,548. Such a resistor assembly is very expensive due to the soldered connections which must be of high quality in order to achieve the lowest possible electrical and thermal contact resistance. Also such a resistor assembly is subject to thermal stress cracks in the soldered joints which cause deterioration or failure of the device.

Positive temperature coefficient resistors having a hollow cylinder shaped resistive body with terminals at opposite end faces are known as set forth in German patent application DE-OS No. 1,465,439. Also, the use of leaf springs for contacting a flat circular resistive body inside a casing is known as set forth in German patent application DE-OS No. 2,540,029. In this, the pressing forces are dependent on the dimensions of the casing.

A general object of this invention is to overcome certain disadvantages of the prior art.

SUMMARY OF THE INVENTION

According to this invention, an electrical heating device for plates using a resistive body can be assembled quickly and effectively, i.e. without unduly large electrical or thermal resistances in the connections to the resistive body. This is accomplished by using a resistive body with at least one flat face thereon being the connection surface for a first electrical terminal. The plate to be heated and the resistive body are provided with aligned openings therethrough and disposed in face-to-face engagement. Fastening means extend through the openings for pressing the resistive body onto the plate. A second electrical terminal is provided on another connection surface of the body. Preferably the second terminal is a second plate having an opening therein and is pressed onto the other face of the resistive body by the fastening means. The second terminal is preferably perforated provided with a central opening and serves as a heat distributing means to improve the temperature distribution on the resistive body. Preferably the resistive body is a flat cylindrical ring with annular connection surfaces and exhibiting a positive temperature coefficient of resistance. The fastening means comprises plural parts including a shank or pin having an integral head and including a keeper element or nut, which is preferably a self-locking press-on nut. A spring washer is provided between the nut and the second plate to maintain a compressive force on the assembly.

A more complete understanding of this invention will be obtained from the detailed description that follows taken with the accompanying drawings.

BEST MODE FOR CARRYING OUT THE INVENTION

Figure 1:
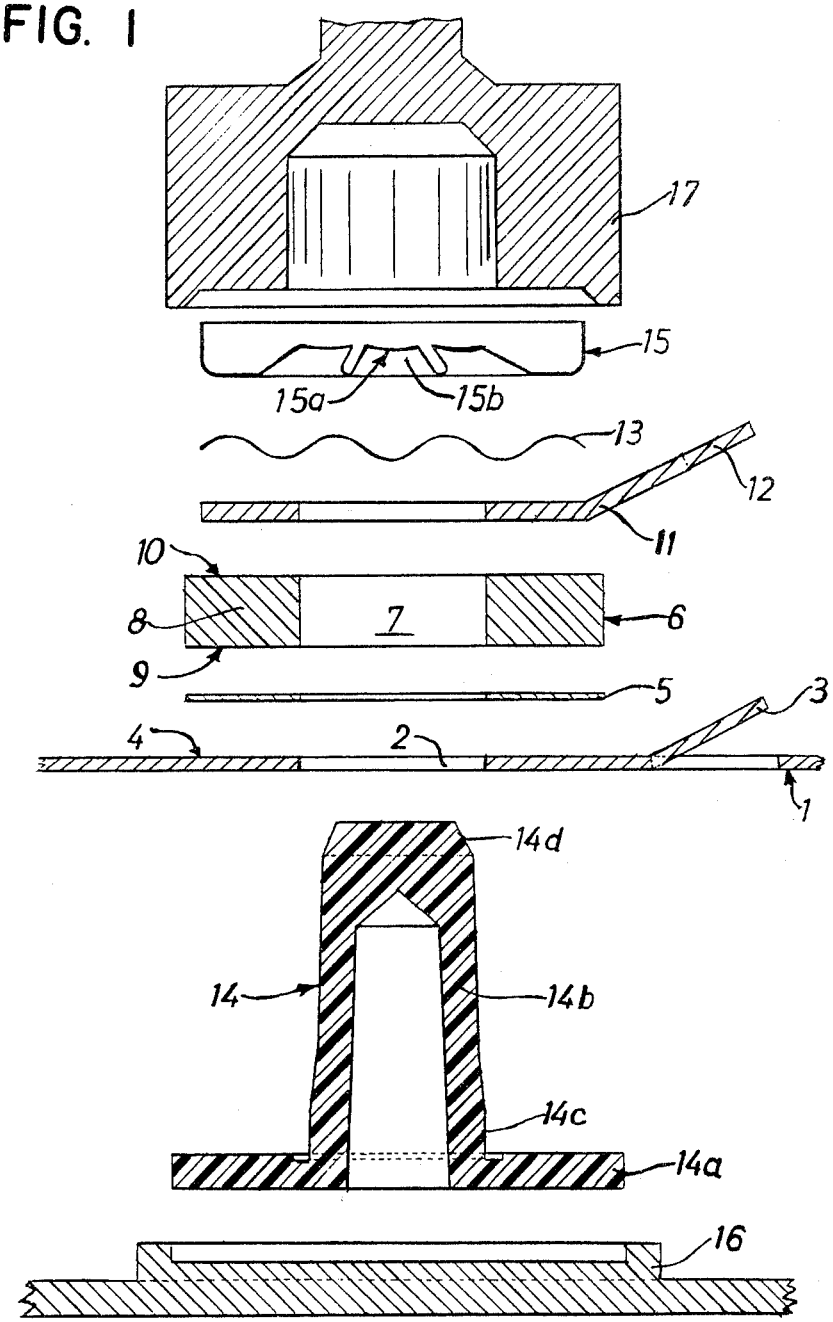
FIG. 1 is an exploded view of the parts of the heating device of this invention.

Referring now to the drawings, there is shown an illustrative embodiment of the invention in a heating device for flat plates. This embodiment is especially adapted for heating an outside rear view mirror of a motor vehicle. It will be appreciated as the description proceeds that the invention is also useful in other applications and embodiments.

FIG. 1 is an exploded view of the parts of the heating device prior to assembly. The parts are disposed between a lower press plate 16 and an upper press plate 17 which are used to assemble the parts in a manner to be described subsequently. The heating device includes a thin plate 1, such as an aluminum sheet, which is to be heated. This plate 1 is suitably adapted to serve as a heat source for a mirror on a motor vehicle. Plate 1 also constitutes a first electrical terminal and includes a round hole 2 and a struck-out prong 3 which serves as electrical connector for connection of the plate to the power supply of the vehicle. A layer of heat and electrically conducting paste 5 is applied onto the surface 4 around the hole 2.

A resistive body 6 having a positive temperature coefficient of electrical resistance is constructed in the form of an annulus or cylindrical ring 8 having a flat annular connecting face 9 and an opposite flat annular connecting face 10. The resistive body 6 is disposed on the paste 5 so that the flat face 9 is in face-to-face relation with the surface 4 of the plate 1. The central opening 7 in the resistive body 6 is aligned with the opening 2 in the plate 1.

Figure 2:
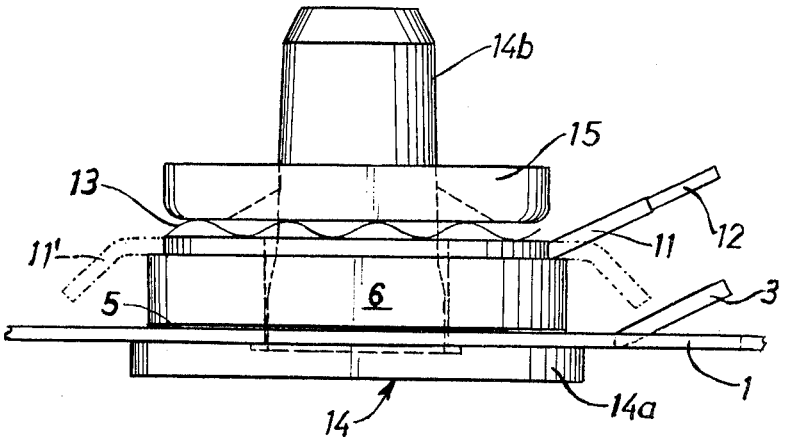
FIG. 2 shows the assembled heating device of this invention.

A second electrical terminal 11 is adapted to provide electrical connection with the connecting face 10 of the resistive body. The terminal 11 comprises a metal plate, which may be a brass plate, having a flat portion with a central opening aligned with opening 7 in the resistive body 6. The terminal 11 is provided with a connector prong 12 for connection with the power supply. The terminal 11 may additionally be provided with an annular flange 11' to form a cup-shaped member, as shown in dotted line in FIG. 2. The terminal 11 or terminal 11 and its flange 11' constitutes heat distributing member for the resistive body. Alternatively, the terminal 11 (without the flange 11') may be used as the electrical terminal and an additional heat distributing plate or cup may be disposed over the terminal. A spring washer 13 in the form of a corrugated ring is disposed on the terminal 11 to maintain a compressive force after the assembly is completed.

Fastening means for the assembly comprises a pin 14 and a press-on nut 15. The pin 14 has a head or flange

14*a* at one end and a shank 14*b* which is suitably hollow. The shank has a stepped diameter with a conical transition region 14*c* between the smaller and larger diameters. It also has a chamfer 14*d* at its free end. The pin 14 is constructed of a heat resistant plastic, such as glass fiber reinforced polycarbonate. The press-on nut 15 is made of spring steel in the form of a plate-shaped washer and provides a central opening 15*a* surrounded by a plurality of gripping fingers 15*b* which extend at an acute angle to the plane of the washer.

The heating device is assembled by disposing the pin 14 on the lower press plate 16. The plate 1 is disposed over the pin 14 and the layer of paste 5 is applied to the upper surface of the plate 1. The resistive body 6 is disposed over the pin and the terminal 11 and spring washer 13 are disposed thereon. Then the press-on nut 15 is placed on the upper end of the pin at the chamfer 14*d*. The central opening of the press-on nut 15 is of smaller diameter than the shank of the pin. The upper press plate 17 is lowered against the press-on nut 15 forcing it onto the pin 14. This causes the gripping fingers 15*b* to be deflected upwardly and the compression force of the press plates causes the spring washer 13 to be compressed. When the desired compression force is achieved, the upper press plate is retracted. The gripping fingers of the press-on nut 15 bite into the pin 14 so that the parts are held under compression, the compressive force being maintained by the spring washer 13. In this condition, good thermal and electrical conduction is provided between the plate 1 and the resistive body 6 as well as between the terminal 11 and the resistive body 6.

It will now be appreciated that the device of this invention does not require any soldered joints for electrical connection or for thermal conduction between the resistive body and the plate to be heated. Also, it will be appreciated that greater tolerance in the dimensions, for example in the thicknesses, of the components is readily compensated by reason of the assembly technique so that sufficient compressive force is always maintained between the resistive body and the plate to be heated and the electrical terminals.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. For use in heating a plate, an electrical heating device including a resistor, the improvement comprising:

a plate to be heated having an opening therein, said resistor being an electrically resistive body having first and second flat faces on opposite sides, said body defining an opening extending from one face to the other, the first face of said resistive body being disposed in face-to-face relation with said plate to be heated with the opening in the body aligned with the opening in the plate, said plate constituting a first electrical terminal on the resistive body, a second electrical terminal being disposed in engagement with the second face of the resistive body and having an opening therein, and fastening means including, a pin of electrically non-conductive material having a head and a shank, said shank extending through the openings in the plate to be heated, the resistive body and the second terminal, and a press-on nut being disposed over the end of said shank urging the plate to be heated, the second terminal and the resistive body against one another.

2. The invention as defined in claim 1 including a spring washer disposed on said shank between said head and said press-on nut for maintaining a compressive force on said plate to be heated, said second terminal and said resistive body.

3. The invention as defined in claims 1 or 2 wherein said second terminal is a plate adapted for distributing heat from said resistive body.

* * * * *